US005944419A

United States Patent [19]

Streiff

[11] Patent Number: 5,944,419

[45] Date of Patent: Aug. 31, 1999

[54] MIXING DEVICE

[75] Inventor: Felix Streiff, Winterthur, Switzerland

[73] Assignee: Sulzer Chemtech AG, Winterthur, Switzerland

[21] Appl. No.: 08/660,434

[22] Filed: Jun. 7, 1996

[30] Foreign Application Priority Data

Jun. 21, 1995 [EP] European Pat. Off. ..... 95810418

[51] Int. Cl.[6] ..... B01F 5/06

[52] U.S. Cl. ..... 366/337; 366/340

[58] Field of Search ..... 366/336–340, 366/181.5; 138/37, 39, 40, 42; 48/189.4

[56] References Cited

U.S. PATENT DOCUMENTS

| | | | |
|---|---|---|---|
| 3,195,865 | 7/1965 | Harder . | |
| 3,406,947 | 10/1968 | Harder . | |
| 3,620,506 | 11/1971 | So . | |
| 3,893,654 | 7/1975 | Miura . | |
| 4,179,222 | 12/1979 | Strom et al. | 366/337 |
| 4,255,124 | 3/1981 | Baranowski, Jr. | 366/338 X |
| 5,492,408 | 2/1996 | Alfare' | 366/337 |

FOREIGN PATENT DOCUMENTS

| | | | |
|---|---|---|---|
| 0163217 | 12/1985 | European Pat. Off. . | |
| 2343352 | 3/1975 | Germany | 366/337 |
| 3214056 | 10/1983 | Germany . | |
| 55-16696 | 5/1980 | Japan | 366/337 |

*Primary Examiner*—Charles E. Cooley
*Attorney, Agent, or Firm*—Townsend and Townsend and Crew LLP

[57] ABSTRACT

The mixer arranged in a tube contains at least one or a plurality of mixing elements which have two axial sections each. To each section is assigned at least one separating flange subdividing the section. The separating flanges of the two sections cross one another. The tube cross section is divided into subareas by the separating flanges. At the boundary between the sections both open subareas and subareas covered by deflection plates are provided. On both sides of each separating flange is placed exactly one open subarea. With respect to successive mixing elements, neighboring separating flanges cross each other as well, and the open subareas are arranged so as to be offset with respect to one another.

24 Claims, 3 Drawing Sheets

Fig.5a
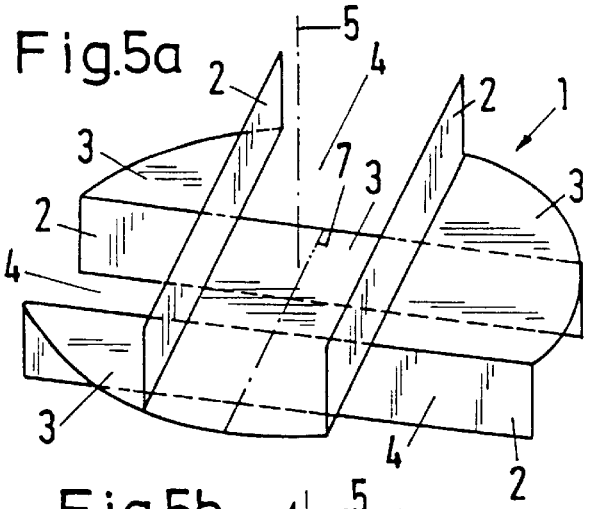
Fig.5b
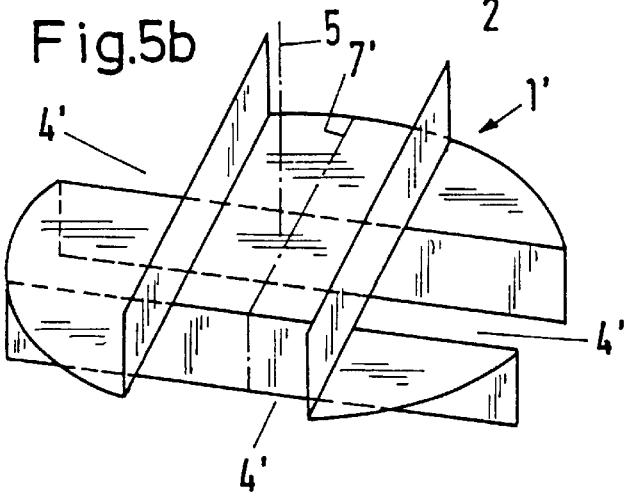
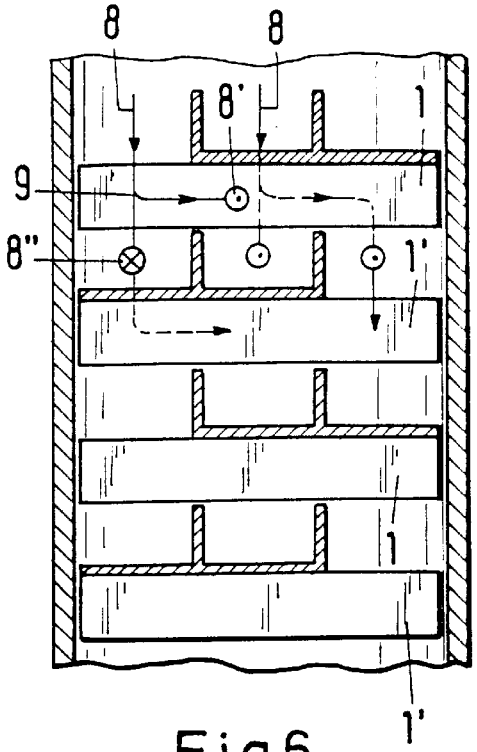
Fig.6
Fig.7a
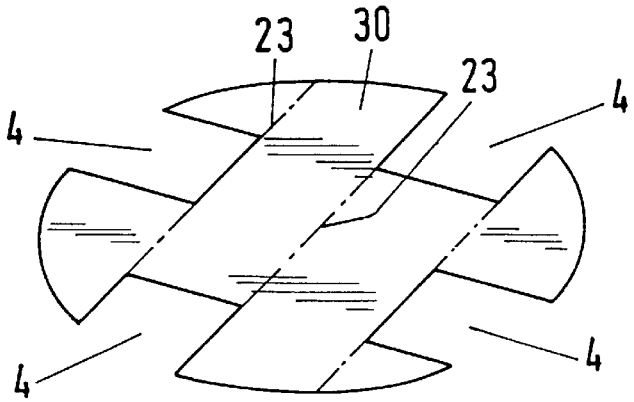
Fig.7b
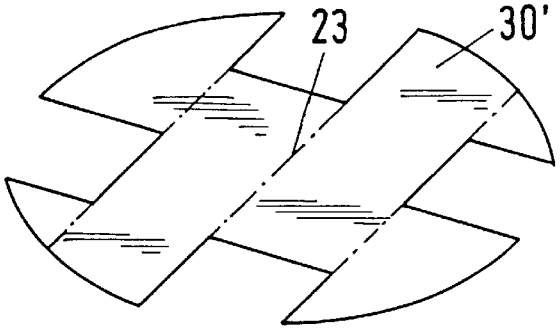

MIXING DEVICE

FIELD OF THE INVENTION

The invention relates to a mixing device or mixer which is arranged in a tube and which contains at least one mixing element or one mixing body.

BACKGROUND OF THE INVENTION

U.S. Pat. No. 3,051,453 discloses a mixer which is composed of a linear array of mixing elements referred to as "multiflux mixing body". This multiflux mixing body, the cross section of which is square, has two channels which gradually narrow in the direction of flow up to the middle of the mixing body and then gradually expand in a plane rotated by 90° after reaching the narrowest point. A medium flowing through the mixing body experiences a rearrangement in which the number of partial layers is doubled.

The multiflux mixing body can—from a geometrical point of view—be constructed of four wedge-shaped partial bodies and two triangular plates. In one embodiment, the wedges have the form of a halved cube which is halved along the diagonal of a face. In each case two of the wedges—the one rotated by 90° with respect to the other—form a united partial body. The two plates form partition walls between the two channels of the mixing body. The partial bodies occupy a volume comprising 25 to 30% of the tube volume associated with the mixing body.

Analogous mixing bodies with four channels—so-called ISG mixing bodies (ISG=Interfacial Surface Generator)—are known (cf. H. Brünemann, G. John "Mischüte und Druckverlust statischer Mischer mit verschiedenen Bauformen", Chemie-Ing.-Techn. 43 (1971) p. 348). The ISG mixing bodies have circular cross sections. In a mixer with ISG mixing bodies, eight partial layers are produced in a medium consisting of two components to be mixed.

The multiflux and ISG mixing bodies require a relatively large amount of material for their construction, and take up 25 to 30% of the tube volume. The lengths of the mixing bodies in the direction of flow are relatively large, and are approximately of the same size as the tube diameter.

SUMMARY OF THE INVENTION

The object of this invention is to create a mixer of the multiflux or ISG type, with mixing bodies or mixing elements that can be constructed of less material. The amount of the unoccupied volume is greater than 80 to 90%, and hence the amount of material required is substantially smaller than that for prior mixers. In addition, the mixing elements of the mixer in accordance with the invention can be substantially shorter, and can be half as long as the tube diameter or shorter—with performance comparable to the known mixing bodies.

The mixer in accordance with the invention has mixing elements of an especially simple form. The mixer comprises a monolithic mixing body with a series of several mixing elements placed one after the other. The mixer can easily be constructed by injection molding of plastics or by precision casting (steel), and two-part tools can be used, especially in the simplest embodiments (two-hole versions). The mixing bodies in accordance with the invention can also be constructed in a simple manner from sheet metal for example.

The mixer in accordance with the invention is especially suitable for viscous media such as plastics, resins or glues (where the Reynolds number $Re=v\cdot D-\rho/\eta$ is less than 1; v: velocity of the flowing medium, D: tube diameter, ρ: density of the medium, η: viscosity). As regards quality of mixing and pressure loss (=NeReD, Ne: Newton number) the mixer in accordance with the invention is superior to the known static mixers. Two flowable media of similar viscosity can be mixed homogeneously over a distance (L) of less than ten tube diameters (D).

Contrary to the known multiflux or ISG mixers, the mixer in accordance with the invention has no channels with confusor- and diffusor-like sections or bores. Experiments showed that simple plates with holes and separating flanges which are placed on the plates yield a surprisingly good quality of mixing. Effects that were to be expected due to the lack of confusor- and diffusor-like sections turned out to have practically no negative influence with respect to the quality of mixing.

For the mixer in accordance with the invention, tubes of arbitrary cross sections can be provided; square or circular cross-sections are, however, preferable.

Experiments were carried out with mixers in accordance with the invention whose mixing elements had 2, 3 and 4 holes each.

The length of the elements was in all cases half the tube diameter. The experiments yielded a homogenization (coefficient of variation $s/\bar{x} \leqq 0.01$) over a distance of 8, 7 and 8 tube diameters respectively. The pressure loss was much smaller than in the known multiflux and ISG mixers.

The measured results are summarized in the following table. The definitions of the quantities $W_{LV}$, $W_{LD}^{1/3}$ and $W_{LL}^{1/3}$ are known for example from the following publication: "Mischen beim Herstellen und Verarbeiten von Kunststoffen" in the series "Kunststofftechnik", VDI-Verlag, Düsseldorf, 1991 (the definition of the coefficient of variation $s/\bar{x}$, see above, can also be found there). These values, which are designated as specific effects, give relative data on the volume of the mixer, its diameter and the mixer length. They are referenced to the known SMX mixer, which is known, for example, from German patent 2,808,854. The homogenization length $(L/D)_h$ has been read for $s/\bar{x}=0.01$ (cf. FIG. 9).

| | Mixer type | NeReD | $(L/D)_h$ | $W_{LV}$ | $W_{LD}^{1/3}$ | $W_{LL}^{1/3}$ |
|---|---|---|---|---|---|---|
| 1* | SMX | 1200 | 10 | 1 | 1 | 1 |
| 2* | 2-hole | 500 | 8 | 0.27 | 0.69 | 0.55 |
| 3* | 3-hole | 1000 | 7 | 0.41 | 0.84 | 0.58 |
| 4* | 4-hole | 2070 | 8 | 1.10 | 1.11 | 0.89 |
| 5* | Multiflux | 920 | 15 | 1.73 | 1.05 | 1.57 |

The multiflux mixer is outperformed with respect to the specific effects by the mixers tested.

BRIEF DESCRIPTION OF THE DRAWINGS

FIG. 6 is a cross-sectional view illustrating a longitudinal section through a mixer with the mixer elements of FIG. 5, FIGS. 7*a,b* are perspective views illustrating deflection plates for mixing elements with three separating flanges (four-hole version)

DETAILED DESCRIPTION OF THE PREFERRED EMBODIMENTS

Figure 1:
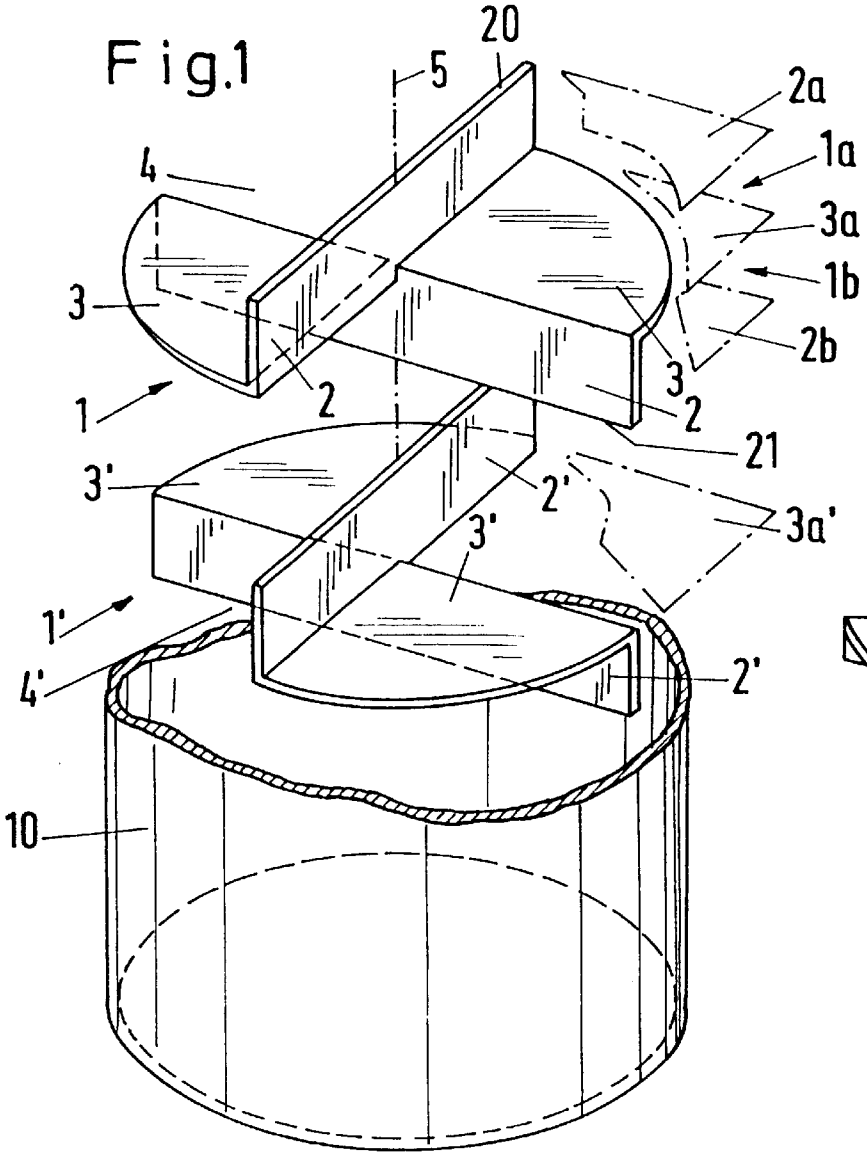
FIG. 1 is an exploded view of a static mixer in accordance with the invention having two mixing elements (two-hole version)

The mixing elements 1 and 1' of FIG. 1 arranged in a tube 10 each comprise two separating flanges 2 and 2', and two deflecting plates 3 and 3' which lie in a plane 3*a*, 3*a*' respectively indicated by the chain-dotted lines. The plane 3*a* lies perpendicular to the tube axis 5 and parallel to planes 2*a* and 2*b*, which define the upper edge 20 and the lower edge 21 of the separating flanges 2 respectively. The three planes 2*a*, 3*a* and 2*b* define and bound two sections 1*a* and 1*b* of the mixing element 1. To each section is assigned one of the two separating flanges 2 subdividing the section. The separating flanges 2 of the two sections 1*a* and 1*b* cross one another at right angles. The tube cross section is subdivided into four equal subareas by the separating flanges 2, where two of these subareas are covered by the deflecting plates 3. The two open subareas are provided as constrictions and passage holes 4 for the medium to be mixed.

The two successive mixing elements 1 and 1' are formed substantially in the same way. However, mixing element 1 represents the mirror image of mixing element 1'. The neighboring separating flanges 2 and 2' cross one another; the open subareas 4 and 4' are arranged in a mutually offset manner.

Figure 2:
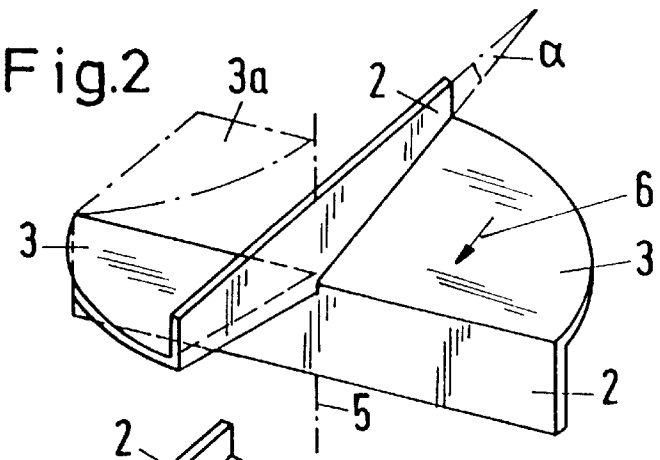
FIGS. 2–4 are perspective views illustrating alternate embodiments of the mixing elements of FIG. 1, FIGS. 5*a,b* are perspective views illustrating mixing elements with two separating flanges per section (three-hole version)
Figure 3:
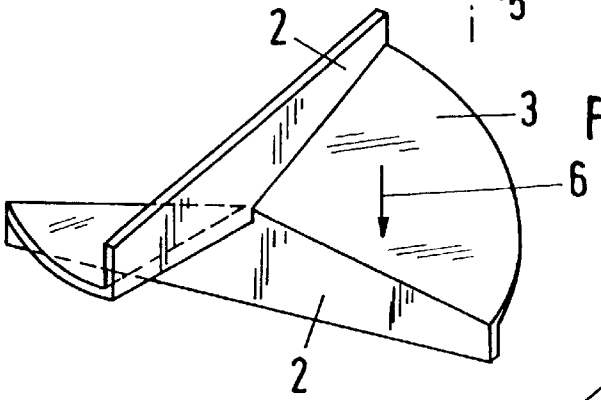
Figure 4:
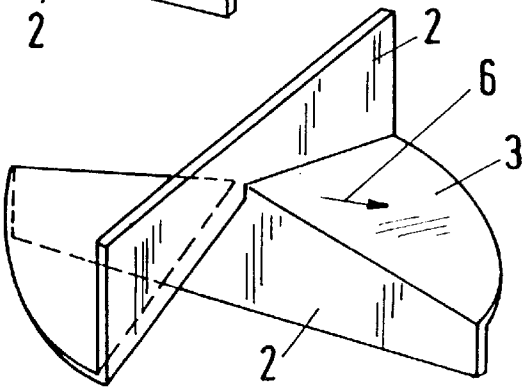

The deflecting plates 3 can also subtend an angle a with the cross-sectional plane 3*a*—see FIG. 2. This angle $\alpha$ is advantageously chosen to be not greater than 30°. FIGS. 3 and 4 show further embodiments with inclined surfaces. If the axis 5 is understood to be vertical, the arrow 6 in FIGS. 2 to 4 represents the fall line of a deflecting plate 3. In FIG. 2 this arrow 6 is parallel to the upper separating flange 2. In the exemplary embodiment of FIG. 3 the arrow 6 is tangential to a circular cylinder concentric with the axis 5. In the exemplary embodiment of FIG. 4 the arrow 6 is directed radially outwards.

FIGS. 5*a* and 5*b* show mixing elements 1 and 1' in each of which two separating flanges 2 are respectively associated with a section bounded by the upper edges of the flanges 2 and the plates 3 and a section bounded by the plates 3 and the lower edges of the flanges 2, as analogous to 1*a* and 1*b* of FIG. 1 (not shown in FIGS. 5*a* and 5*b*). On both sides of each separating flange 2 is placed exactly one open subarea 4. The mixing element 1' with the open subareas 4' represents an immediately neighboring element of the mixing element 1. The open subareas 4 and 4' are arranged in a mutually offset manner. In the three-hole version (FIGS. 5*a* and 5*b*) the two mixing elements 1 and 1' are identical and not mirror imaged as in the two-hole version (FIG. 1).

For efficient manufacture of the three-hole mixing body (FIGS. 5*a* and 5*b*) by the process of injection molding, the mixing elements can be divided into two halves. The boundaries between the half elements are shown in FIGS. 5*a* and 5*b* as chain-dotted lines 7 and 7' respectively. Monolithic partial bodies each containing a series of such half elements can be constructed simply using two-part tools. The entire mixing body (1, 1') is formed by joining together two matching monolithic partial bodies.

The longitudinal section of FIG. 6 shows the individual mixing elements 1 and 1' alternately stacked closely upon one another. Spacings between individual neighboring elements or between all elements can however also be provided. Mixing elements built in with spacing can be connected by connecting pieces to form a monolithic mixer.

In FIG. 6 the course of the flow of the medium to be mixed is also indicated by the arrows 8, 8' and 8". Arrow 8' is perpendicular to the plane of the diagram and is directed forwards; arrow 8"—also normal—is directed towards the rear. The reference symbol 9 points toward a position at which the arrows indicate the creation of two partial streams.

It is advantageous for the deflection plates 3 of each element (1, 1') to lie in a common plane. In the presence of at least two separating flanges 2 per section (three-hole version) several deflection plates 3 can be joined together to form a common plate or a single plate 30 (four-hole version), as shown in FIGS. 5*a* and 5*b* and the corresponding FIGS. 7*a* and 7*b* for the four-hole version.

In each of FIGS. 7*a* and 7*b* only the single and common deflection plate 30 or 30' is shown. The chain-dotted lines 23 represent the lower edges of the upper separating flanges. As in the previous two-hole version the neighboring mixing elements are mirror images of one another.

In place of a circular cross section, the mixer in accordance with the invention can have a cross section of any other shape, for example that of a square. The angles of crossing between the neighboring separating flanges 2, 2' can also deviate from 90°. The sections 1*a* and 1*b* (see FIG. 1) can be of different lengths. It is advantageous for the length of the sections 1*a* and 1*b* to be in the range from D/8 to D; it is preferably D/4.

Figure 8:
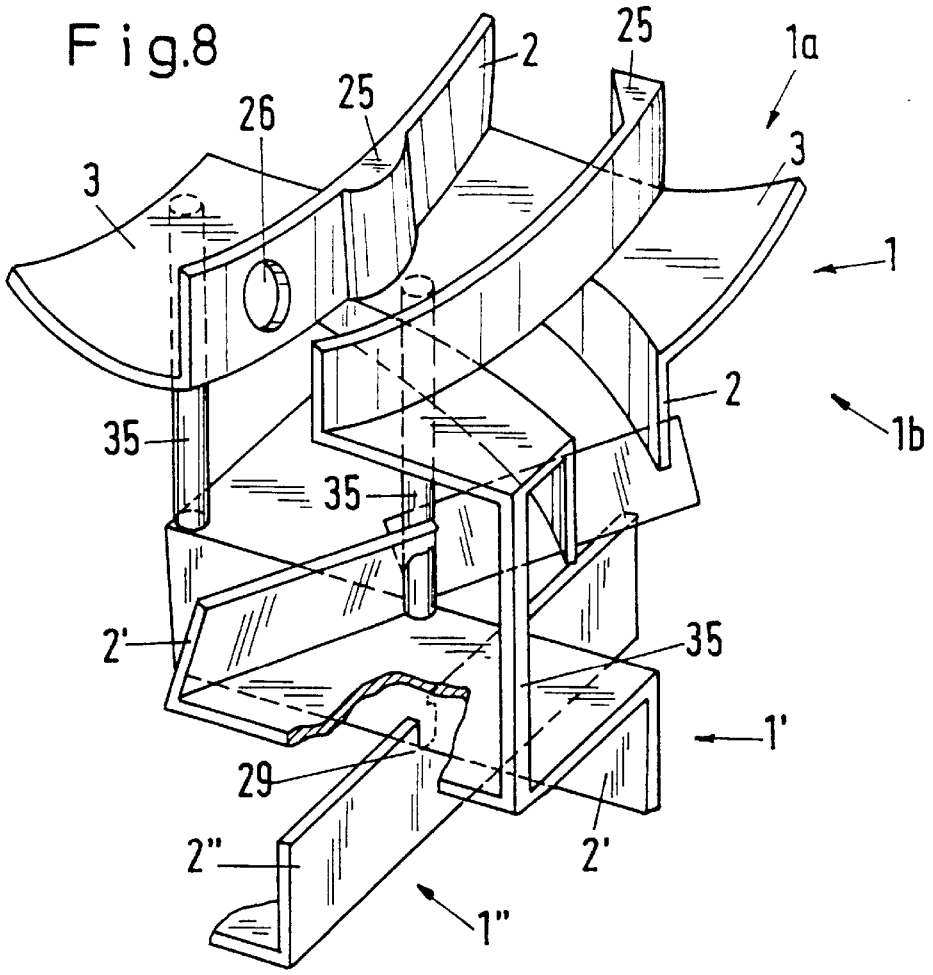
FIG. 8 is a partial perspective view illustrating mixing elements for a square tube.

FIG. 8 illustrates what deviations from the simple form described above are conceivable. In this embodiment, connecting elements 35 are placed between the spaced mixing elements 1, 1'. The separating flanges 2 have additional elements 25, 26 as strengtheners or stream deflectors. Separating flanges 2' and 2" of neighboring mixing elements 1' and 1" are fitted together at the position 29. Some of the separating flanges 2 and deflection plates 3 are nonplanar.

The mixing elements 1 and 1' have different numbers of separating flanges 2 and 2' per section 1*a* and 1*b* respectively, namely two and one respectively. One separating flange 2 has a recess 29. FIG. 8 is understood merely as illustrating individual features; this particular combination of all features listed in a single mixer does not preclude other combinations.

The tube 10 can also be shaped conically (not shown) so that it tapers in the direction of flow. In this case, the mixing bodies 1, 1' must be constructed in differing sizes corresponding to the varying cross section.

Figure 9:
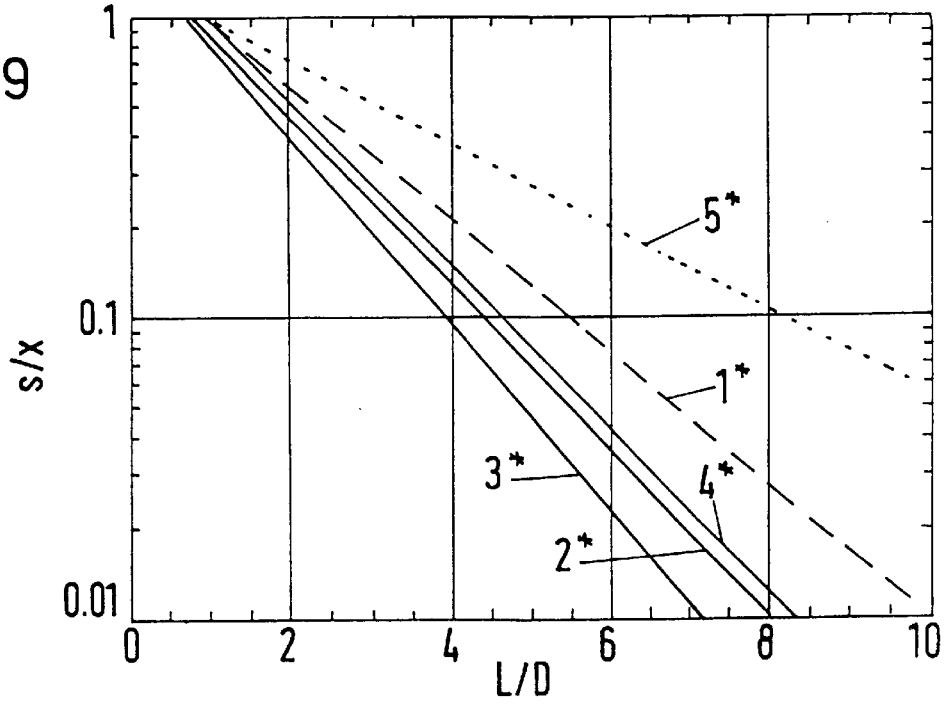
FIG. 9 is a diagram with measured results for the coefficient of variation $s/x^-$ (with $x^-=0.5$).

The diagram in FIG. 9 shows the dependence of the coefficient of variation $s/x^-$ on L/D for $x^-$ 0.5 in accordance with the above-mentioned experiments. $x^-=0.5$ means that the proportions of the components to be mixed are equally large. The reference symbols 1* to 5* refer to the mixer types that are listed in the above table.

The mixer in accordance with the invention, which can be constructed monolithically of little material, can advantageously be constructed of an economical, combustible plastic by injection molding. This mixer is especially suitable for use as a one-way article.

The mixer in accordance with the invention can also be used to mix turbulently flowing media.

I claim:

1. A mixer arranged in a tube with a tube axis defining the general direction of a flow of materials for mixing, the mixer including at least one mixing element which comprises:

a plurality of deflecting plates disposed nonparallel to the tube axis;

at least one first separating flange extending across the tube and having a first connecting boundary which is connected to at least some of the plurality of deflecting plates and a first open boundary which is spaced from the plurality of deflecting plates generally in the direction of the tube axis, a cross-sectional plane perpendicular to the tube axis across the first open boundary and the plurality of deflecting plates defining a first axial section in the tube, the at least one first separating flange dividing the first axial section into a plurality of subareas which include first blocked areas having at least one of the plurality of deflecting plates as a boundary and first open subareas not bounded by the deflecting plates, each first separating flange having one first open subarea to each side thereof; and at least one second separating flange extending across the tube and having a second connecting boundary which is connected to at least some of the plurality of deflecting plates and a second open boundary which is spaced from the plurality of deflecting plates generally in the direction of the tube axis opposite from the at least one first separating flange, a cross-sectional plane perpendicular to the tube axis across the second open boundary and the plurality of deflecting plates defining a second axial section in the tube, the at least one second separating flange dividing the second axial section into a plurality of subareas which include second blocked areas having at least one of the plurality of deflecting plates as a boundary and second open subareas not bounded by the deflecting plates, each second separating flange having one second open subarea to each side thereof, the at least one second separating flange being nonparallel to the at least one first separating flange.

2. The mixer of claim 1 which includes a plurality of the mixing elements oriented along the tube axis forming a series of neighboring mixing elements, wherein each pair of neighboring mixing elements have the at least one first separating flange of one neighboring mixing element adjacent and nonparallel to the at least one second separating flange of another neighboring mixing element.

3. The mixer of claim 1 which includes a plurality of the mixing elements oriented along the tube axis forming a series of neighboring mixing elements, wherein each pair of neighboring mixing elements have the first open subareas of one neighboring mixing element adjacent to and offset from the second open subareas of another neighboring mixing element.

4. The mixer of claim 1, wherein the first separating flanges divide the first axial section into subsections of approximately equal sizes.

5. The mixer of claim 1, wherein the at least one second separating flange crosses the at least one first separating flange at an angle of about 90°.

6. The mixer of claim 1, wherein the first axial section and the second axial section are approximately equal in size.

7. The mixer of claim 1 which includes a plurality of the mixing elements oriented along the tube axis, wherein at least one of the mixing elements has a length along the tube axis defined between the first open boundary of the at least one first separating flange and the second open boundary of the at least one second separating flange, the tube has a maximum tube diameter, and the length is smaller than the maximum tube diameter.

8. The mixer of claim 7, wherein the length is smaller than half of the maximum tube diameter.

9. The mixer of claim 1, wherein the plurality of deflecting plates lie in a common plane.

10. The mixer of claim 9, wherein the plurality of deflecting plates form a single plate.

11. The mixer of claim 1, wherein at least one of the plurality of deflecting plates is inclined by an angle (alpha) relative to a cross-sectional plane of the tube which is perpendicular to the tube axis.

12. The mixer of claim 11, wherein the angle (alpha) is less than 30°.

13. The mixer of claim 1 which includes a plurality of the mixing elements oriented along the tube axis, wherein the mixing elements form a monolithic structure.

14. The mixer of claim 13, wherein the monolithic structure is made by injection molding.

15. The mixer of claim 1 which includes a plurality of the mixing elements oriented along the tube axis forming a series of neighboring mixing elements, wherein the first open boundary of each mixing element is adjacent to and spaced from the second open boundary of a neighboring mixing element.

16. The mixer of claim 15, further comprising a plurality of connection elements which connect each mixing element with the neighboring mixing element.

17. The mixer of claim 1, wherein the tube is square or circular in cross-section.

18. The mixer of claim 1, wherein the at least one first separating flange and/or the at least one second separating flange have strengtheners or flow deflectors.

19. The mixer of claim 1. which includes a plurality of the mixing elements oriented along the tube axis forming a series of neighboring mixing elements, wherein the at least one first separating flange of each mixing element has a slot with which the at least one second separating flange of a neighboring mixing element cooperates to connect the neighboring mixing elements together.

20. The mixer of claim 1, wherein at least one of the at least one first separating flange, the at least one second separating flange, and the plurality of deflection plates is nonplanar.

21. The mixer of claim 1, wherein at least one of the at least one first separating flange, the at least one second separating flange, and the plurality of deflection plates has a recess.

22. The mixer of claim 1 which includes a plurality of the mixing elements oriented along the tube axis, wherein the tube is conical tapering in the direction of the tube axis and the mixing elements are differently sized in accordance with the tapering to fit inside the conical tube.

23. The mixer of claim 1 which includes a plurality of the mixing elements oriented along the tube axis, wherein at least one mixing element has different numbers of the first separating flange and second separating flange from another mixing element.

24. Utilization of the mixer of claim 1 for mixing materials including plastics, resins, glues or other viscous materials, wherein the Reynolds number for the materials flowing through the mixer is less than 1.

* * * * *